US007635281B2

(12) United States Patent
Mizuguchi

(10) Patent No.: US 7,635,281 B2
(45) Date of Patent: Dec. 22, 2009

(54) CONNECTOR PLUG WITH PUSHER BLADES FOR CLAMPING A COAXIAL CABLE

(75) Inventor: Satoshi Mizuguchi, Tokyo (JP)

(73) Assignee: Kopek Japan Corporation, Tokyo (JP)

( * ) Notice: Subject to any disclaimer, the term of this patent is extended or adjusted under 35 U.S.C. 154(b) by 0 days.

(21) Appl. No.: 12/103,379

(22) Filed: Apr. 15, 2008

(65) Prior Publication Data

US 2008/0268686 A1 Oct. 30, 2008

(30) Foreign Application Priority Data

Apr. 16, 2007 (JP) ..... 2007-106752

(51) Int. Cl.
*H01R 9/05* (2006.01)

(52) U.S. Cl. ..... 439/578

(58) Field of Classification Search ..... 439/578, 439/584, 585, 394, 803, 668, 91; 174/75 C, 174/84 C See application file for complete search history.

(56) References Cited

U.S. PATENT DOCUMENTS 5,205,761 A * 4/1993 Nilsson ..... 439/578
5,997,335 A * 12/1999 Kameyama et al. ..... 439/394
6,407,542 B1 * 6/2002 Conte ..... 324/158.1
6,753,475 B2 * 6/2004 Takahashi et al. ..... 174/75 C
7,131,868 B2 * 11/2006 Montena ..... 439/578
7,318,742 B2 * 1/2008 Morikawa ..... 439/394

* cited by examiner

*Primary Examiner*—Chandrika Prasad
(74) *Attorney, Agent, or Firm*—Greenblum & Bernstein P.L.C.

(57) ABSTRACT

A connector plug for a coaxial cable (capable of mounting to the coaxial cable simply and reliably with no attaching failure due to excess or insufficient force by using a usual tool) includes a tubular ferrule to be inserted from the top end of the coaxial cable having a central conductor, an insulator, a shield, and a sheath for protecting them disposed coaxially from the center, to the inside of the shield thereof. A clamping tool clamps and fixes the sheath from the outside of the ferrule. The clamping tool includes a cap fitted externally to the top end of the cable and a pair of pusher blades inserted through slits formed to the circumferential wall thereof and pinches the sheath in a direction perpendicular to the longitudinal direction thereof. Each of the pusher blades is provided with a clamping engagement that is engaged to the slit opening edge on the inner surface of the cap and fixes the blade not detachably.

16 Claims, 4 Drawing Sheets

CONNECTOR PLUG WITH PUSHER BLADES FOR CLAMPING A COAXIAL CABLE

TECHNICAL FIELD

The present invention concerns a connector plug for a coaxial cable which is attached to the top end (i.e., a connection end) of the coaxial cable for connecting the coaxial cable to a receptacle disposed in various kinds of high frequency equipments such as communication and broadcasting apparatus.

BACKGROUND ART

For connecting a coaxial cable used for transmission of high frequency signals, for example, in television broadcasting or data communication, a connector for a coaxial cable such as an F-type connector has been used in which a connector plug attached to the top end of the coaxial cable is inserted and fixed to a receptacle formed on the side of a high frequency equipment.

FIGS. 4(*a*)-(*f*) are explanatory views showing an existent connector plug for a coaxial cable used in usual domestic wirings.

In a coaxial cable 11, as shown in FIG. 4(*a*), a central conductor 12, an insulator 13, an outer conductor 14 comprising braided wires as a shield, and a sheath 15 protecting them are arranged concentrically from a center of the coaxial cable.

In a connector plug 21 as shown in FIG. 4(*b*), a connection nut 23 is rotationally attached to a tubular ferrule 22 inserted between the insulator 13 and the outer conductor 14 from the top end of the coaxial cable 11, and the sheath 15 is clamped over the ferrule 22 by a clamping ring 24 in a state of inserting the ferrule 22 between the insulator 13 and the outer conductor 14.

When the connector plug 21 is attached to the top end 11*a* of the coaxial cable 11, the clamping ring 24 is inserted in a state of exposing the central conductor 12 and the outer conductor 14 each by a predetermined length as shown in FIG. 4(*a*), then the tubular ferrule 22 is firmly inserted between the insulator 13 and the outer conductor 14 as shown in FIGS. 4(*b*) to (*c*), and the clamping ring 24 is deformed by using pincers, etc., in a state of locating the clamping ring 24 above the ferrule 22 as shown in FIG. 4(*c*), to complete the attachment as shown in FIGS. 4(*d*) to (*f*).

In a case of using the thus mounted connector plug 21, it may be inserted into a receptacle formed in a high frequency equipment and a connection nut 23 is screw coupled to a male screw formed at the outer periphery of the receptacle.

In the above-mentioned type of deforming and fixing of the clamping ring 24, if the ferrule 22 should happen to be inserted initially without insertion of the clamping ring 24, since the ferrule could not be detached simply, it was obliged to incise the sheath 15, detach the ferrule 22, and then cut the top end 11*a* of the coaxial cable 11, and conduct fabrication again.

Further, deforming the clamping ring 24 resulted in a tendency to cause attaching failure due to a lack of reliability, such that when an excessive force is applied to injure the clamping ring 24 this induces cracking therefrom and causes easy detachment and, on the other hand, when the force is insufficient, tightening becomes lose to cause easy detachment.

While a connector plug of high reliability for professional use employed, for example, in office wirings of broadcasting stations is present, this not only requires an expensive exclusive clamping tool but also is complicate and requires a number of parts, which increases the cost and can not be used as the domestic use.

DISCLOSURE OF THE INVENTION

Subject to be Solved by the Invention

In view of the above, it is a technical subject of the invention to make it possible for easy and reliable mounting to a coaxial cable by anyone, without causing attachment failure by excessive or insufficient force, while using a usual tool such as an pincers, but without using an exclusive clamping tool.

Means for Solution of the Subject

For solving the subject, the present invention provides a connector plug for a coaxial cable including;

a tubular ferrule to be inserted from the top end of the coaxial cable having a central conductor, an insulator, a shield, and a sheath for protecting them disposed coaxially from the center, to the inside of the shield thereof, and a clamping tool for clamping and fixing the sheath from the outside of the ferrule, wherein the clamping tool includes a cap fitted externally to the top end of the cable and a pair of pusher blades inserted through slits formed to the circumferential wall thereof and pinching the sheath in a direction perpendicular to the longitudinal direction thereof, and each of the pusher blades is provided with a clamping engagement that is engaged to the slit opening edge on the inner surface of the cap and fixes the blade not detachably.

EFFECT OF THE INVENTION

According to the connector plug for the coaxial cable of the invention, when the pusher blades are pinched strongly by a usual tool such as pincers and thrusted as far as the clamping position in a state of externally engaging the cap by inserting the ferrule into the coaxial cable fabricated at the top end, the clamping engagements are engaged at the slit opening edges on the inner surface of the cap to fix the blade not detachably thereby pinching the cable.

In this case, since the clamping ring is not used, this is free from the problem of re-fabrication caused by forgetting the insertion of the clamping ring through the coaxial cable.

BEST MODE FOR PRACTICING THE INVENTION

For enabling easy and reliable mounting to a coaxial cable by any one with no attaching failure due to excess or insufficient force, by using a usual tool such as pinchers, but without using an exclusive clamping tool, an embodiment of the invention provides a connector plug for a coaxial cable including;

a tubular ferrule to be inserted from the top end of the coaxial cable having a central conductor, an insulator, a shield, and a sheath for protecting them disposed coaxially from the center, to the inside of the shield thereof, and a clamping tool for clamping and fixing the sheath from the outside of the ferrule, wherein the clamping tool includes a cap fitted externally to the top end of the cable and a pair of pusher blades inserted through slits formed to the circumferential wall thereof and pinching the sheath in a direction perpendicular to the longitudinal direction thereof, and each of the pusher blades is provided with a clamping engagement that is engaged to the slit opening edge on the inner surface of the cap and fixes the blade not detachably.

The present invention is to be described with reference to the drawings.

FIG. 1 is an explanatory view showing a connector plug for a coaxial cable according to the invention, FIG. 2 is a side elevational view showing assembling procedures thereof, and FIG. 3 is an outer looking view thereof.

EXAMPLE 1

A connector plug 1 for a coaxial cable of this embodiment is used being attached at the top end of a coaxial cable 11 for connecting the same to a receptacle disposed in various types of high frequency equipments such as communication and broadcasting apparatus.

In the coaxial cable 11, a central conductor 12, an insulator 13, an outer conductor 14 comprising braided wires as a shield, and a sheath 15 for protecting them are disposed coaxially from the center thereof.

In the connector plug 1, a central conductor 12, an insulator 13, an outer conductor 14 comprising braided wires as a shield and a sheath 15 for protecting them are disposed coaxially from the center.

In the connector plug 1, a connection nut 3 is rotationally attached to a tubular ferrule 2 which is configured to be inserted between the insulator 13 and the outer conductor 14 (as well as sheath 15), the insulator 13 and the outer conductor arranged concentrically from the center of the coaxial cable 11 and, in a state of inserting the ferrule between the insulator 13 and the outer conductor 14, a clamping tool 4 clamps the sheath 15 from the outside of the ferrule.

The clamping tool 4 has a substantially cylindrical cap 5 made of aluminum die-cast externally fitted to a cable top end 11*a* and a pair of pusher blades 6 made of aluminum die-cast inserted into the slits 5*a* formed in the circumferential wall of the cap and pinching the sheath 15 in the direction perpendicular to the longitudinal direction thereof.

The pusher blade 6 has a blade main body 7 and guides 8 protruded from the blade main body 7 on both surface and rear face side and outer peripheral side.

The outer periphery of the blade main body 7 is formed as an arcuate face 7*a* which is in flush with the outer peripheral surface of the cap when thrusted as far as a clamping position, and concave faces 7*b* are formed at the top end thereof for pinching the coaxial cable.

Then the guide 8 has an upper end portion 8*a* protruded from the outer periphery of the blade main body 7 as a press portion undergoing the force of a tool and has a clamping engagement 10 that is engaged to the slit opening edge 5*b* on the inner surface of the cap to fix the blade 6 not detachably when the blade 6 in thrusted to the clamping position, and an anti-detaching engagement 10 that is engaged to the slit opening edge 5*b* on the inner surface of the cap to inhibit the movement of the blade in the detaching direction when it is at a non-clamping position capable of inserting and detaching the cable 11.

Each of the engagements 9 and 10 is formed as a wedge shape gradually increasing the height toward the direction opposite to the inserting direction of the blade 6.

An example of the constitution of the invention is has been described above and the effect thereof is to be described.

At first, the pusher blades 6, 6 are inserted into the slits 5*a* in the cap 5 of the connector plug 1 and, as shown in FIG. 2(*a*) and FIG. 3(*a*), this keeps the pusher blades 6 from detaching from the slits 5*a* in an unused state as they are, and missing of the blade 6 can be prevented.

Further, since the blades 6 can not be thrusted unless a certain force is applied, the blades 6 are not thrusted as far as the clamping position in the unused state as they are.

Then, upon mounting to the top end of the coaxial cable 11, the top end of the ferrule is fabricated to expose the central conductor 12 and the outer conductor 14 of the coaxial cable 11 each by a predetermined length, and the tubular ferrule 22 is firmly inserted between the insulator 13 and the external conductor 14, as shown in FIGS. 2(*b*), (*c*) and FIG. 3(*a*).

In this state, as shown in FIGS. 2(*d*), (*e*) and FIG. 3(*b*), when the guide upper end portions 8*a* for both of the pusher blades 6 are pinched by pincers or the like and thrusted into the clamping position where the arcuate face 7*a* of the blade main body 7 is in flush with the outer peripheral surface of the cap, the clamping engagements 9 are engaged to the slit opening edges 5*b* on the inner surface of the cap to fix the blades 6 not detachably and, at the same time, the concave surfaces 7*b* at the top end of the blades are pressed against the coaxial cable 11 in which the coaxial cable 11 is firmly pinched between the two blades 6 from the outside of the ferrule 2 and the connector plug 1 can be attached reliably.

As described above, according to this embodiment, the connector plug 1 can be attached reliably to the top end of the coaxial cable 11 sufficiently firmly by merely thrusting the ferrule 2 to the coaxial cable 11 fabricated at the top end and thrusting the pressure blades 6, 6 by using a usual tool such as pincers, compared with a case of fixing by the clamping ring, and it is no more necessary to use any exclusive clamping tool or it does not cause attachment failure due to excess or insufficient force.

INDUSTRIAL APPLICABILITY

The present invention is applicable to the use of a connector plug for the coaxial cable attached to the top end thereof for connecting the coaxial cable to a receptacle disposed in various kinds of high frequency equipments such as communication and broadcasting apparatus.

DESCRIPTION OF REFERENCES

Figure 1:
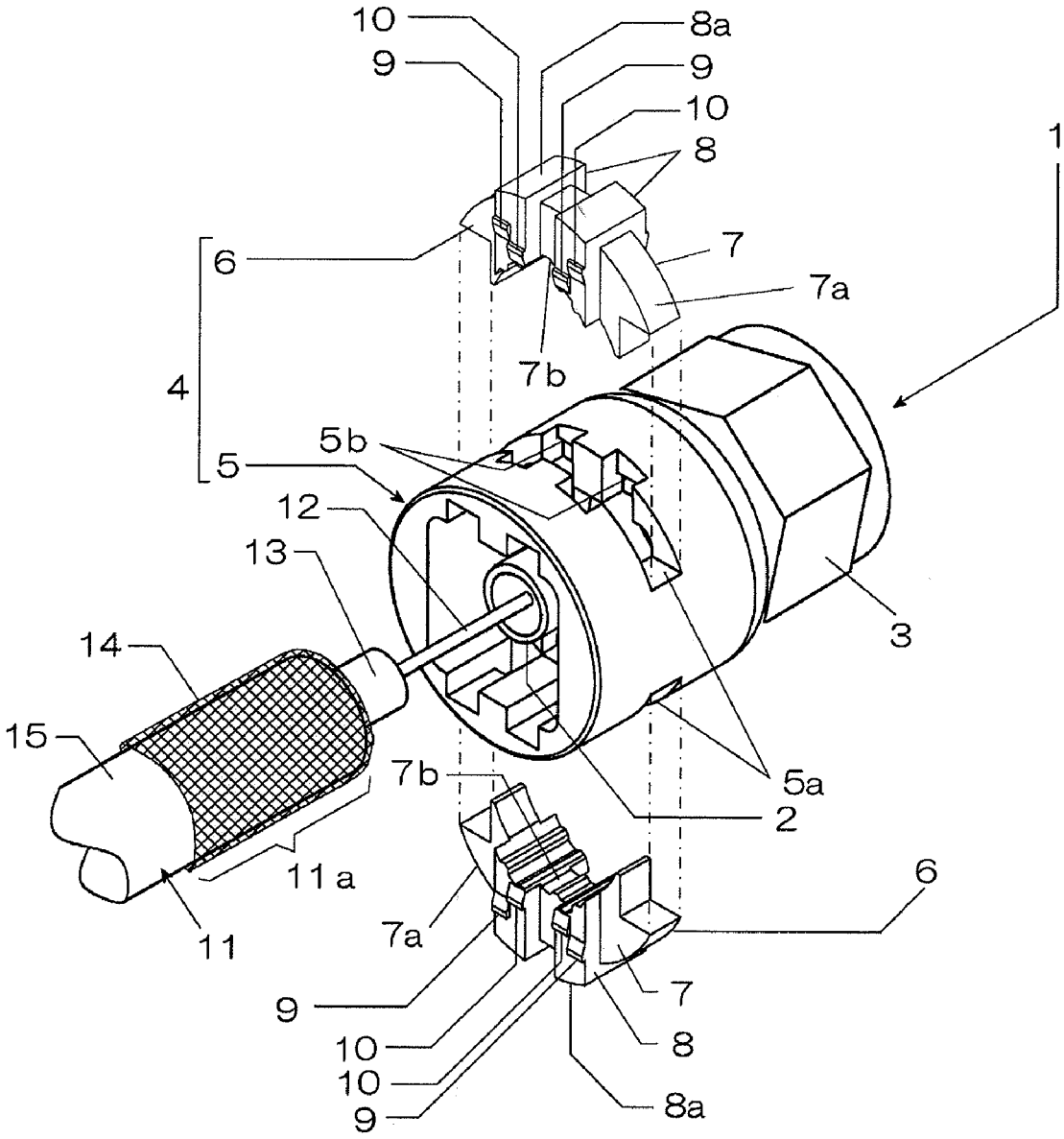
FIG. 1 is an explanatory view showing a connector plug for a coaxial cable according to the invention.
Figure 2A:
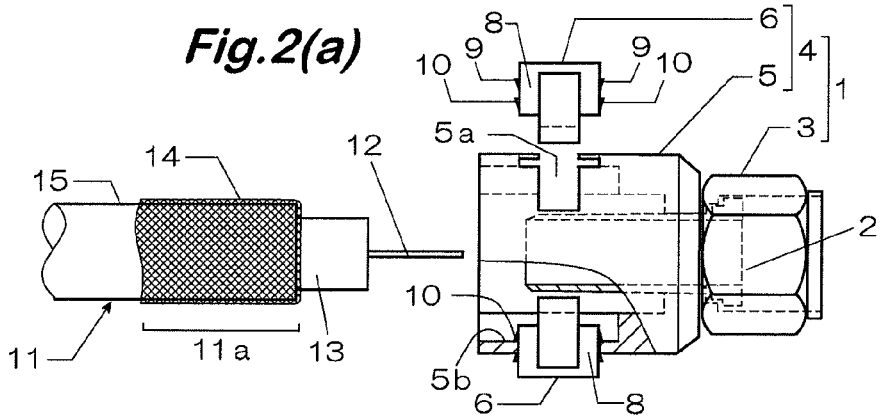
FIG. 2 is an explanatory view showing assembling procedures thereof.
Figure 2B:
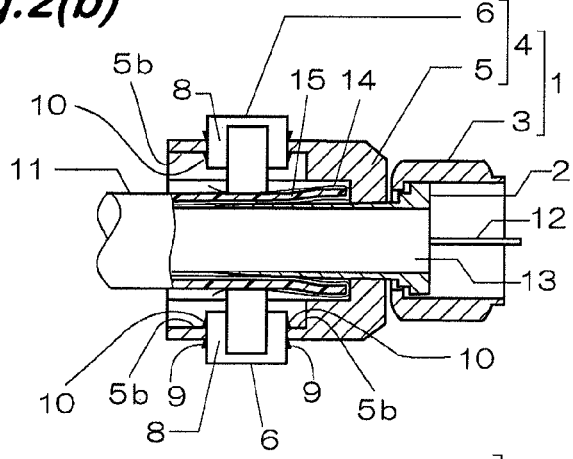
Figure 2C:
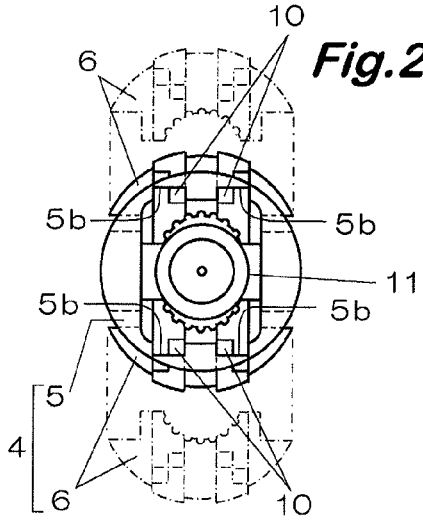
Figure 2D:
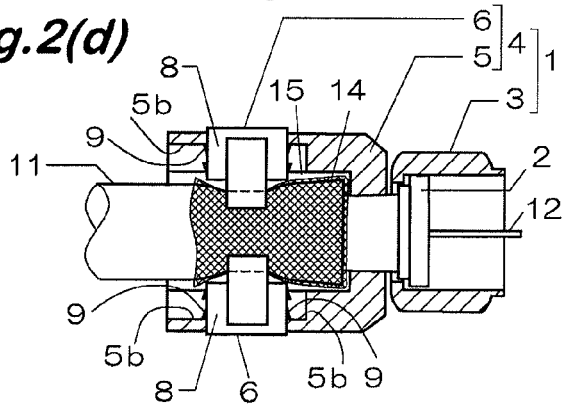
Figure 2E:
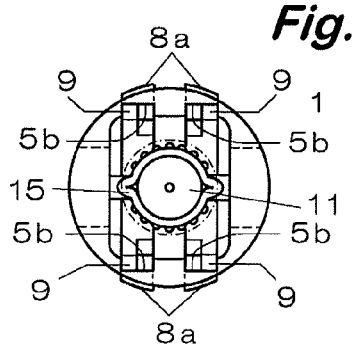
Figure 3A:
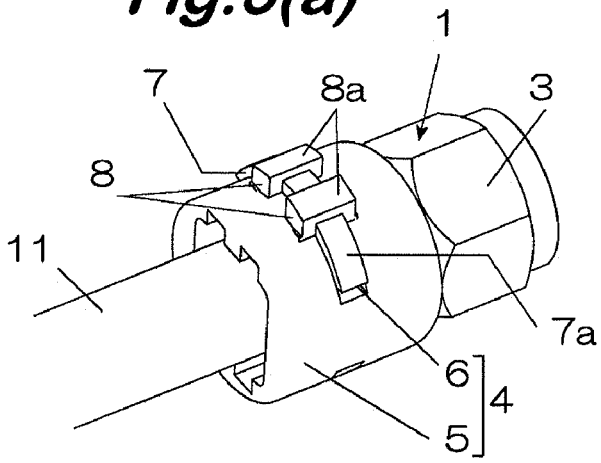
FIG. 3 is an outer looking view thereof.
Figure 3B:
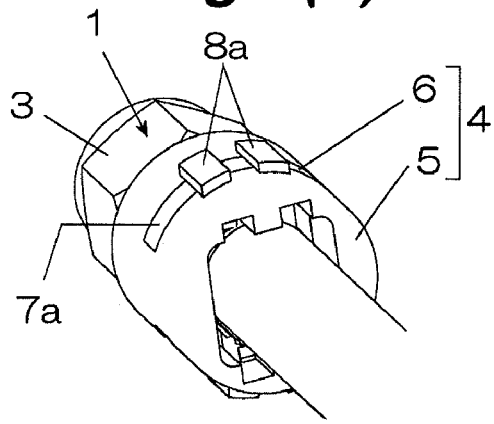
Figure 4A:
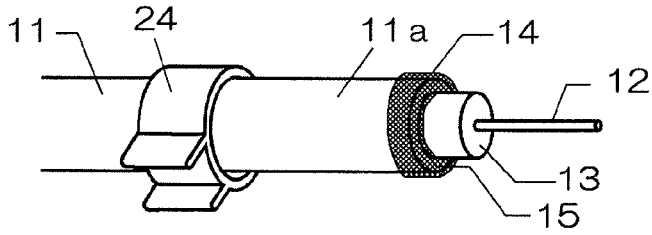
Fig.4(a) prior art
FIG. 4 is an explanatory view showing assembling procedures of a connector plug for a coaxial cable.
Figure 4B:
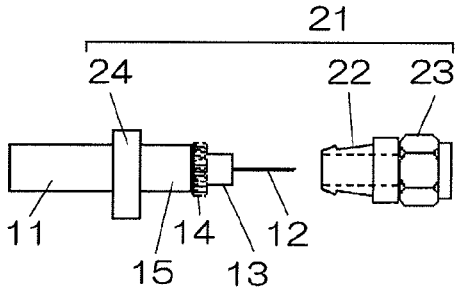
Fig.4(b) prior art
Figure 4C:
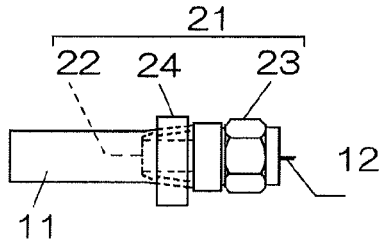
Fig.4(c) prior art
Figure 4D:
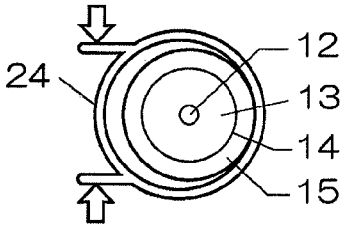
Fig.4(d) prior art
Figure 4E:
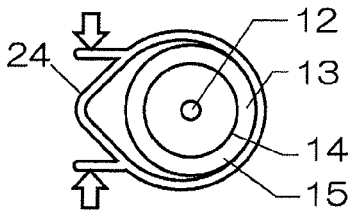
Fig.4(e) prior art
Figure 4F:
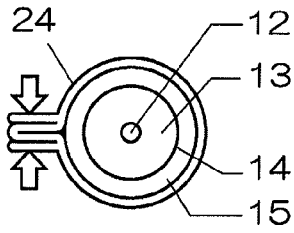
Fig.4(f) prior art

1 connector plug for coaxial cable
2 ferrule
3 connection nut
4 clamping tool
5 cap
5*a* slit
5*b* slit opening edge
6 pusher blade
7 blade main body
9 clamping engagement
10 anti-detaching engagement

11 coaxial cable
12 central conductor
13 insulator
14 external conductor
15 sheath

The invention claimed is:

1. A connector plug for a coaxial cable, the coaxial cable having a central conductor, an insulator, a shield, and a sheath concentrically arranged from a center of the coaxial cable to an outer surface of the coaxial cable, the connector plug comprising:

a tubular ferrule configured to be inserted between the sheath and insulator of the coaxial cable, a clamping tool that clamps and fixes the sheath from an outside of the ferrule, wherein the clamping tool comprises a cap fitted externally to the connection end of the coaxial cable and a pair of pusher blades inserted through slits formed in a circumferential wall of the cap, and the pair of pusher blades pinching the sheath in a direction perpendicular to a longitudinal direction of the sheath, and each of the pusher blades is provided with a clamping engagement that engages a slit opening edge provided on an inner surface of the cap, the clamping engagement fixing the blade to form an un-detachable connection when the clamping engagement is positioned at a clamping position.

2. The connector plug for a coaxial cable according to claim 1, wherein each of the pusher blades is provided with an anti-detaching engagement finger which engages the slit opening edge such that each pusher blade is inhibited from moving in a direction of detaching the pair of pusher blades when the pair of pusher blades are at a non-clamping position which allows inserting and detaching the coaxial cable therebetween.

3. The connector plug for a coaxial cable according to claim 1, wherein the cap is formed into a cylindrical shape and the pusher blades are provided at an outer periphery with an arcuate surface which is flush with an outer peripheral surface of the cap when the pusher blades are in a clamping position.

4. The connector plug for a coaxial cable according to claim 1, wherein a pressed portion configured to receive a force exerted by a tool is formed on an outer periphery of the pusher blades.

5. The connector plug for a coaxial cable according to claim 1, wherein ends of the pusher blades are each formed into a concave shape to pinch the coaxial cable.

6. The connector plug for a coaxial cable according to claim 2, wherein the cap is formed into a cylindrical shape and the pusher blades are provided at the outer periphery with an arcuate surface which is flush with an outer peripheral surface of the cap when the pusher blades are in a clamping position.

7. The connector plug for a coaxial cable according to claim 2, wherein a pressed portion configured to receive a force exerted by a tool is formed on an outer periphery of the pusher blades.

8. The connector plug for a coaxial cable according to claim 3, wherein a pressed portion configured to receive a force exerted by a tool is formed on an outer periphery of the pusher blades.

9. The connector plug for a coaxial cable according to claim 6, wherein a pressed portion configured to receive a force exerted by a tool is formed on an outer periphery of the pusher blades.

10. The connector plug for a coaxial cable according to claim 2, wherein ends of the pusher blades are each formed into a concave shape to pinch the coaxial cable.

11. The connector plug for a coaxial cable according to claim 3, wherein ends of the pusher blades are each formed into a concave shape to pinch the coaxial cable.

12. The connector plug for a coaxial cable according to claim 4, wherein ends of the pusher blades are each formed into a concave shape to pinch the coaxial cable.

13. The connector plug for a coaxial cable according to claim 6, wherein ends of the pusher blades are each formed into a concave shape to pinch the coaxial cable.

14. The connector plug for a coaxial cable according to claim 7, wherein ends of the pusher blades are each formed into a concave shape to pinch the coaxial cable.

15. The connector plug for a coaxial cable according to claim 8, wherein ends of the pusher blades are each formed into a concave shape to pinch the coaxial cable.

16. The connector plug for a coaxial cable according to claim 9, wherein ends of the pusher blades are each formed into a concave shape to pinch the coaxial cable.

* * * * *